US010717564B2

(12) United States Patent
Huang

(10) Patent No.: US 10,717,564 B2
(45) Date of Patent: Jul. 21, 2020

(54) CHILD RESISTANT ZIPPER BAG

(71) Applicant: Dongguan Xueliang Packaging Materials Co., Ltd., Dongguan (CN)

(72) Inventor: Liwen Huang, Guangdong (CN)

( * ) Notice: Subject to any disclaimer, the term of this patent is extended or adjusted under 35 U.S.C. 154(b) by 0 days.

(21) Appl. No.: 16/452,538

(22) Filed: Jun. 26, 2019

(65) Prior Publication Data

US 2019/0315524 A1 Oct. 17, 2019

(51) Int. Cl.
*B65D 33/00* (2006.01)
*B65D 33/25* (2006.01)

(52) U.S. Cl.
CPC ..... *B65D 33/2508* (2013.01); *B65D 2215/00* (2013.01)

(58) Field of Classification Search
CPC ..... B65D 33/2508; B65D 2215/00
USPC ..... 383/61.2, 63
See application file for complete search history.

(56) References Cited

U.S. PATENT DOCUMENTS 4,878,763 A * 11/1989 Ausnit ..... B65D 33/2508 383/65
5,017,021 A * 5/1991 Simonsen ..... B65D 33/2541 383/63
6,088,887 A * 7/2000 Bois ..... B65D 33/2508 24/399
7,306,370 B2 * 12/2007 Howell ..... B65B 9/093 383/204
2002/0020481 A1 * 2/2002 Bodolay ..... B65D 33/2583 156/66
2012/0045151 A1 * 2/2012 Eouzan ..... B65D 33/2541 383/42
2014/0161374 A1 * 6/2014 Septien Rojas .... B65D 33/2541 383/63
2014/0270586 A1 * 9/2014 Petkovsek ..... B65D 33/2508 383/63
2016/0122087 A1 * 5/2016 Takigawa ..... B65D 33/2508 383/63

* cited by examiner

*Primary Examiner* — Peter N Helvey
(74) *Attorney, Agent, or Firm* — Prakash Nama; Global IP Services, PLLC

(57) ABSTRACT

The present application provides a child resistant zipper bag. The zipper of the protective zipper bag is designed with a special structure and can only be opened in a special way, so that children can be effectively prevented from opening the bag casually, thereby playing a role of protecting children. Moreover, the first connection bar is assembled with the second connection bar through the second meshing teeth being meshed with the first meshing teeth. Therefore, the movement between a first zipper belt and a second zipper belt is limited, and the opening of the bag body due to sliding between the first zipper belt and the second zipper belt is avoided.

8 Claims, 9 Drawing Sheets

CHILD RESISTANT ZIPPER BAG

BACKGROUND OF THE INVENTION

The present invention relates to the field of packaging products, and in particular to a child resistant zipper bag.

A zipper bag has a reusable zipper structure which can be easily opened and closed at will, and an excellent sealing effect can be realized when it is closed. The zipper bags can be used for the inner and outer packaging of various small and medium-sized items. The sealing bags can be used to store various snack food, tea, marine products, etc., and to prevent moisture, water, insect, and prevent things from being dropped and scattered; and the sealing bags can also be used to package clothing and other daily necessities, thus having a wide range of uses.

Sealing bags in the prior art has the following disadvantages:

1. If a pushing force F1 parallel to the length direction is applied to the zipper belt on one side of the zipper bag, a pushing force F2 parallel to the length direction is applied to the zipper belt on the other side of the zipper bag, and the pushing force F1 is opposite to the pushing force F2 in direction, the zipper belts on both sides of the zipper bag are easily twisted and deformed due to sliding on both sides, and the mouth of sealing bag is thus opened, which leads to its insufficient sealing capability;

2. However, many commercially available products may be harmful to children, especially children under the age of five, who may try to swallow or incorporate these products into bodies in other ways.

Therefore, the packaging industry is researching for a packaging bag capable of preventing child from opening and the zipper belts on both sides thereof may not slip.

BRIEF SUMMARY OF THE INVENTION

To solve the above problem, the present invention provides a child resistant zipper bag, which can prevent children from opening the bag, limit the movement between the first zipper belt and the second zipper belt and prevent the opening of the bag body due to sliding between the first zipper belt and the second zipper belt.

To achieve the above purpose, the present invention adopts the following technical solution: a child resistant zipper bag, comprising a zipper and a bag body, wherein the zipper is mounted in the bag body; the bag body comprises a front sheet and a rear sheet, the front sheet and the rear sheet realizing opening or closing through the zipper, and characterized in that: the zipper comprises a first zipper belt and a second zipper belt, the first zipper belt comprises a male-end fixing strip, wherein the inner side surface of the male-end fixing strip is provided with a first connection bar extending in the length direction of the male-end fixing strip and a zipper male rail extending in the length direction of the male-end fixing strip, and the surface of the first connection bar is provided with continuous first meshing teeth; the second zipper belt comprises a female-end fixing strip, wherein the inner side surface of the female-end fixing strip is provided with a second connection bar extending in the length direction of the female-end fixing strip and a zipper female rail extending in the length direction of the female-end fixing strip, and the surface of the second connection bar is provided with continuous second meshing teeth; the zipper male rail is assembled with the zipper female rail, and the first connection bar is assembled with the second connection bar through the first meshing teeth being meshed with the second meshing teeth; the upper end and the lower end of the male-end fixing strip are respectively heat-sealed and fitted to the inner side surface of the front sheet, and the upper end and the lower end of the female-end fixing strip are respectively heat-sealed to the inner side surface of the rear sheet; neither the part between the upper end of the male-end fixing strip and the lower end of the male-end fixing strip nor the zipper male rail is heat-sealed and fitted to the front sheet, forming a non-heat-sealed fitting region; an auxiliary flap slot is delimited on the outer side surface of the front sheet corresponding to the non-heat-sealed fitting region, and an auxiliary open flap is formed, the auxiliary open flap being outward turned around the joint between the lower end of the male-end fixing strip and the front sheet.

Further, both the zipper male rail and the first connection bar are unitarily molded on the inner side surface of the male-end fixing strip.

Further, both the zipper female rail and the second connection bar are unitarily molded on the inner side surface of the female-end fixing strip.

Further, the zipper female rail and the zipper male rail are arranged in parallel and in alignment with each other.

Further, the first connection bar and the second connection bar are arranged in parallel and in alignment with each other.

Further, the auxiliary flap slot is of a circular arc structure.

Further, the zipper male rail consists of a plurality of strip-shaped protrusions, the zipper female rail consists of a plurality of strip-shaped grooves, barbs are provided at the top ends of the strip-shaped protrusions and the strip-shaped grooves, and the strip-shaped protrusions are embedded into the strip-shaped grooves.

Further, the side surface of the auxiliary open flap is provided with a prompting sign.

The present invention has the advantageous effects:

1. After the zipper female rail and the zipper male rail are engaged, when a user forcibly pulls the upper end of the front sheet and the upper end of the rear sheet of the bag body towards both sides by two hands, because the zipper female rail and the zipper male rail are engaged and only the lower end of the zipper female rail is connected with the inner side of the rear sheet, the pulling force on one side is acted on the joint between the zipper female rail and the female-end fixing strip, and the pulling force on the other side is acted on the upper end of the zipper male rail, therefore, the upper end of the zipper female rail is biased towards the male-end fixing strip, so that the bag body cannot be opened; and when the user forcibly pulls the auxiliary open flap and the upper end of the rear sheet to both sides respectively, the pulling force on one side is acted on the joint between the zipper female rail and the female-end fixing strip, and the pulling force on the other side is acted on the lower end of the zipper male rail, so that the zipper female rail and the zipper male rail may be separated, thereby opening the bag body. The zipper of the child resistant zipper bag of the present application is designed with a special structure and is only opened in a special way, so that children can be effectively prevented from opening the bag casually. The child resistant zipper bag is especially suitable for packaging articles that may be harmful to children, thereby playing a role of protecting children, and has high safety and good practicability.

2. The first connection bar is assembled with a second connection bar through a second meshing teeth being meshed with a first meshing teeth, while the zipper female rail and the zipper male rail are engaged. Therefore, the movement between the first zipper belt and the second zipper belt is limited, and the opening of the bag body due to sliding between the first zipper belt and the second zipper belt is prevented.

Figure 1:
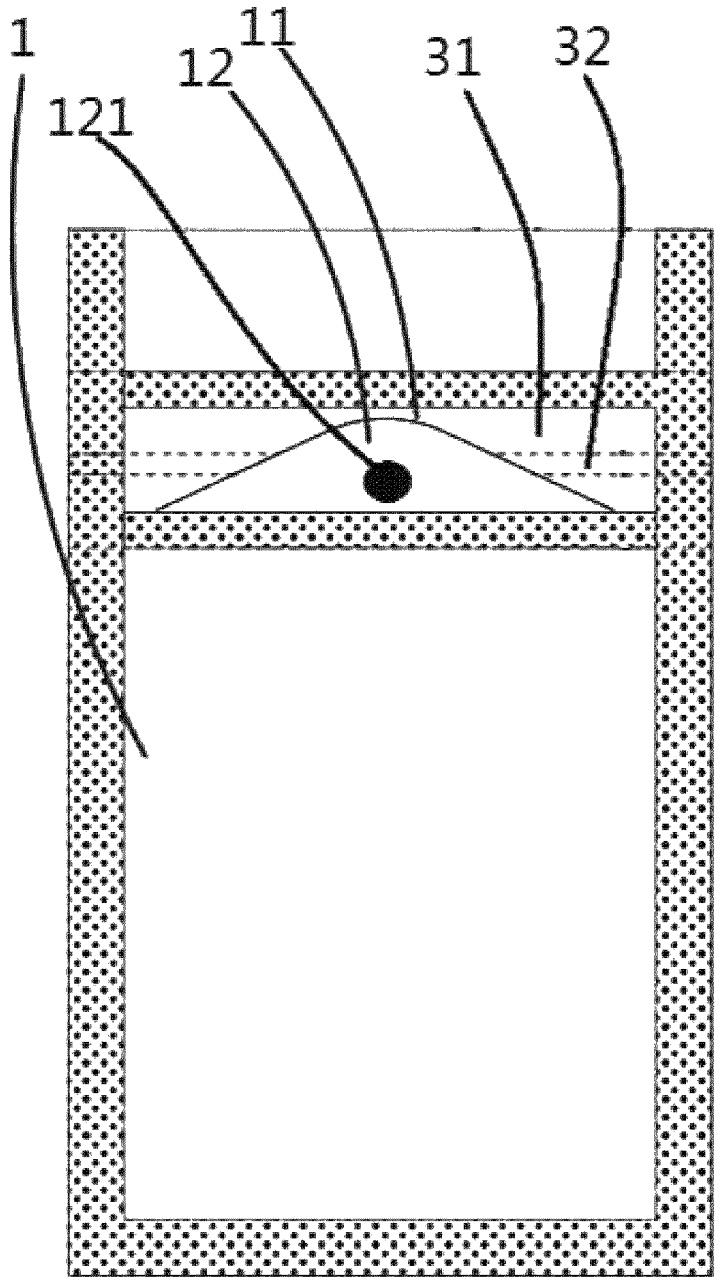
FIG. 1 is a structural schematic diagram of a front sheet of the present invention.
Figure 2:
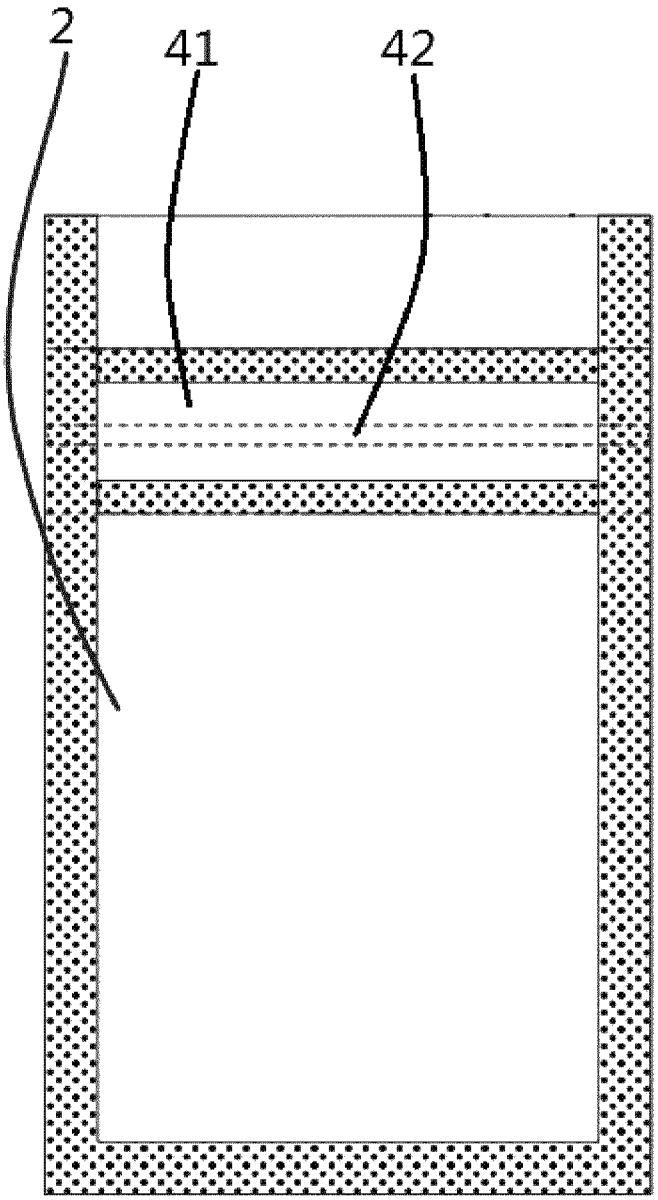
FIG. 2 is a structural schematic diagram of a rear sheet of the present invention.
Figure 3:
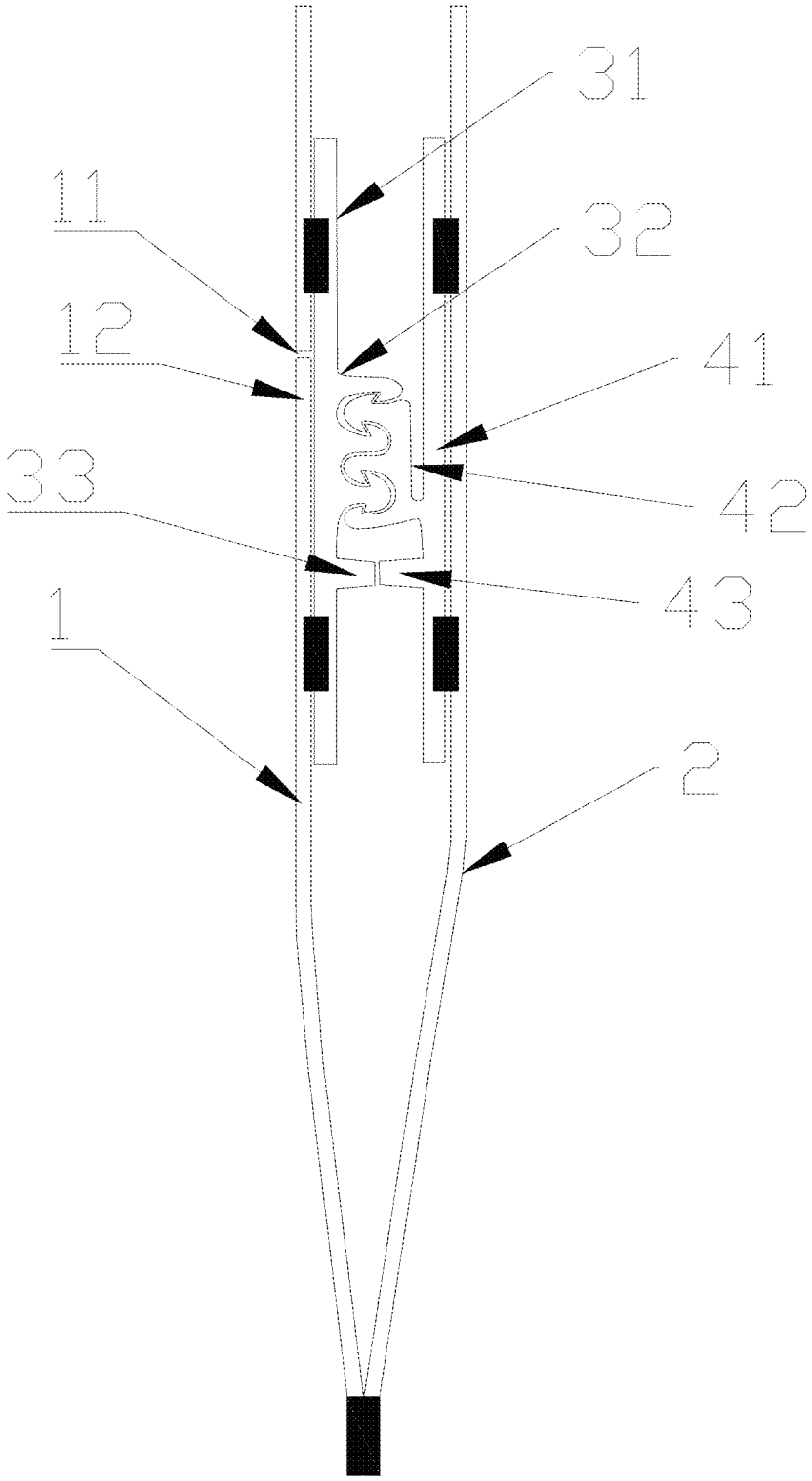
FIG. 3 is a side sectional view of a child resistant zipper bag of the present invention.

Legends: 1. front sheet; 11. auxiliary flap slot; 12. auxiliary open flap; 2. rear sheet; 121. prompting sign; 31. male-end fixing strip; 32. zipper male rail; 321. strip-shaped protrusion; 3211. barb; 33. first connection bar; 331. first meshing tooth; 41. female-end fixing strip; 42. zipper female rail; 421. strip-shaped groove; 43. second connection bar; 431. second meshing tooth.

DETAILED DESCRIPTION OF THE INVENTION

As shown in FIGS. 1-10, the present invention relates to a child resistant zipper bag, comprising a zipper and a bag body, wherein the zipper is mounted in the bag body; the bag body comprises a front sheet 1 and a rear sheet 2, the front sheet 1 and the rear sheet 2 controlling the opening or closing of the bag body through the zipper, and characterized in that: the zipper comprises a first zipper belt and a second zipper belt, the first zipper belt comprises a male-end fixing strip 31 and a first connection bar 33 parallel to the male-end fixing strip 31, wherein the first connection bar 33 is fixedly provided on the inner side surface of the male-end fixing strip 31, the surface of the first connection bar 33 is provided with continuous first meshing teeth 331 in the length direction thereof, and the inner side surface of the male-end fixing strip 31 is also provided with a zipper male rail 32 extending in the length direction of the male-end fixing strip 31; the second zipper belt comprises a female-end fixing strip 41, a zipper female rail 42 parallel to the female-end fixing strip 41, and a second connection bar 43 parallel to the female-end fixing strip 41, wherein the surface of the second connection bar 43 is provided with continuous second meshing teeth 431 in the length direction thereof, the second connection bar 43 is fixedly provided on the inner side surface of the female-end fixing strip 41, and is assembled with the first connection bar 33 through the first meshing teeth 331 being meshed with the second meshing teeth 431, and the lower end of the zipper female rail 42 is fixedly provided on the inner side surface of the female-end fixing strip 41 and is connected with the zipper male rail 32; the upper end of the outer side surface of the male-end fixing strip 31 and the lower end of the outer side surface of the male-end fixing strip 31 are respectively heat-sealed and fitted to the inner side surface of the front sheet 1, and the middle part of the outer side surface of the male-end fixing strip 31 (the position corresponding to the zipper male rail 32) is not heat-sealed and fitted to the inner side surface of the front sheet 1; the upper end of the outer side surface of the female-end fixing strip 41 and the lower end of the outer side surface of the female-end fixing strip 41 are respectively heat-sealed and fitted to the inner side surface of the rear sheet 2, and the middle part of the outer side surface of the female-end fixing strip 41 (the position corresponding to the zipper female rail 42) is not heat-sealed and fitted to the inner side surface of the rear sheet 2; neither the part between the upper end of the male-end fixing strip 31 and the lower end of the male-end fixing strip 31 nor the zipper male rail 32 is heat-sealed and fitted to the front sheet 1, forming a non-heat-sealed fitting region; an auxiliary flap slot 11 is delimited on the outer side surface of the front sheet 1 corresponding to the non-heat-sealed fitting region, and an auxiliary open flap 12 is formed, the auxiliary open flap 12 being outward turned around the joint between the lower end of the male-end fixing strip 31 and the front sheet 1.

Figure 4:
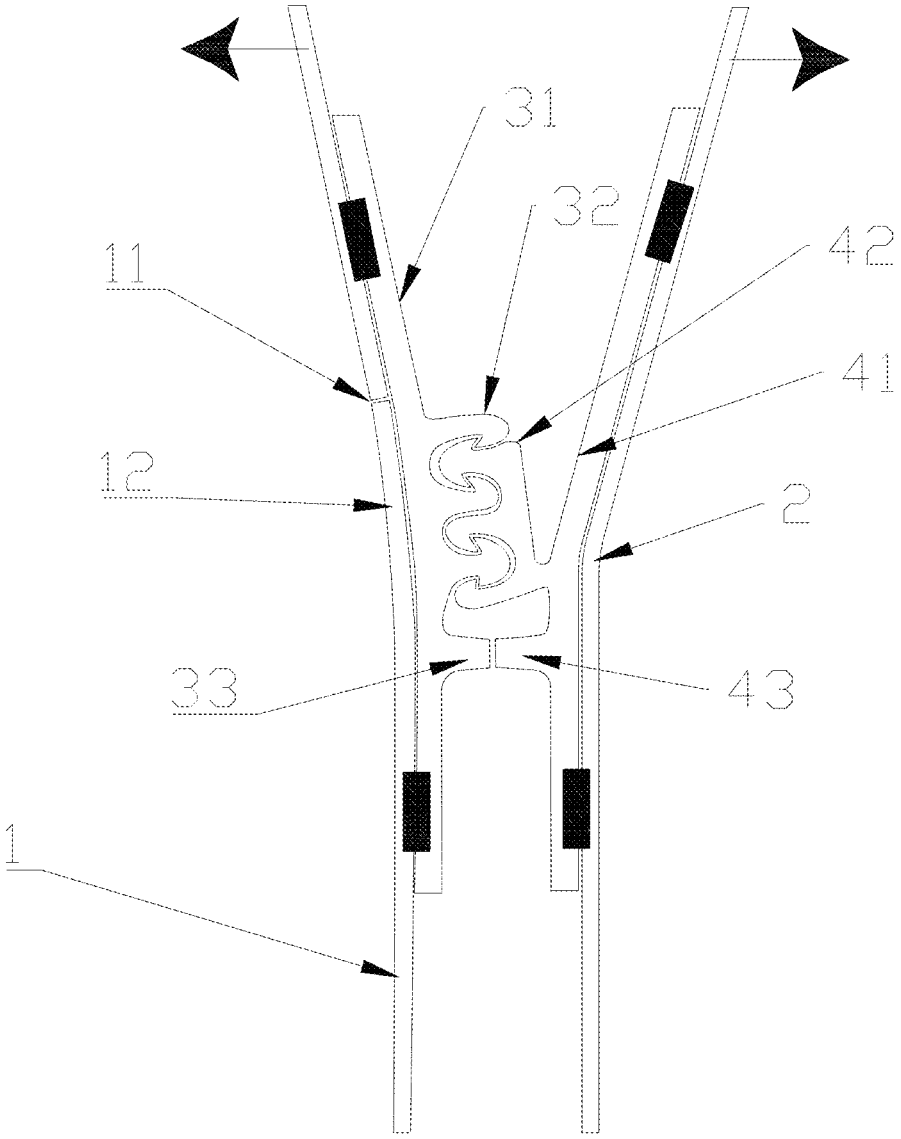
FIG. 4 is a side sectional view of a child resistant zipper bag when a user pulls a bag body in a conventional mode.

As shown in FIG. 4, after the zipper female rail 42 and the zipper male rail 32 are engaged, when a user forcibly pulls the upper end of the front sheet 1 and the upper end of the rear sheet 2 of the bag body towards both sides respectively by two hands, because the zipper female rail 42 and the zipper male rail 32 are engaged and only the lower end of the zipper female rail 42 is connected with the inner side of the rear sheet 2, the pulling force on one side is acted on the joint between the zipper female rail 42 and the female-end fixing strip 41, and the pulling force on the other side is acted on the upper end of the zipper male rail 32, therefore, the upper end of the zipper female rail 42 is biased towards the male-end fixing strip 31, so that the bag body cannot be opened.

Figure 5:
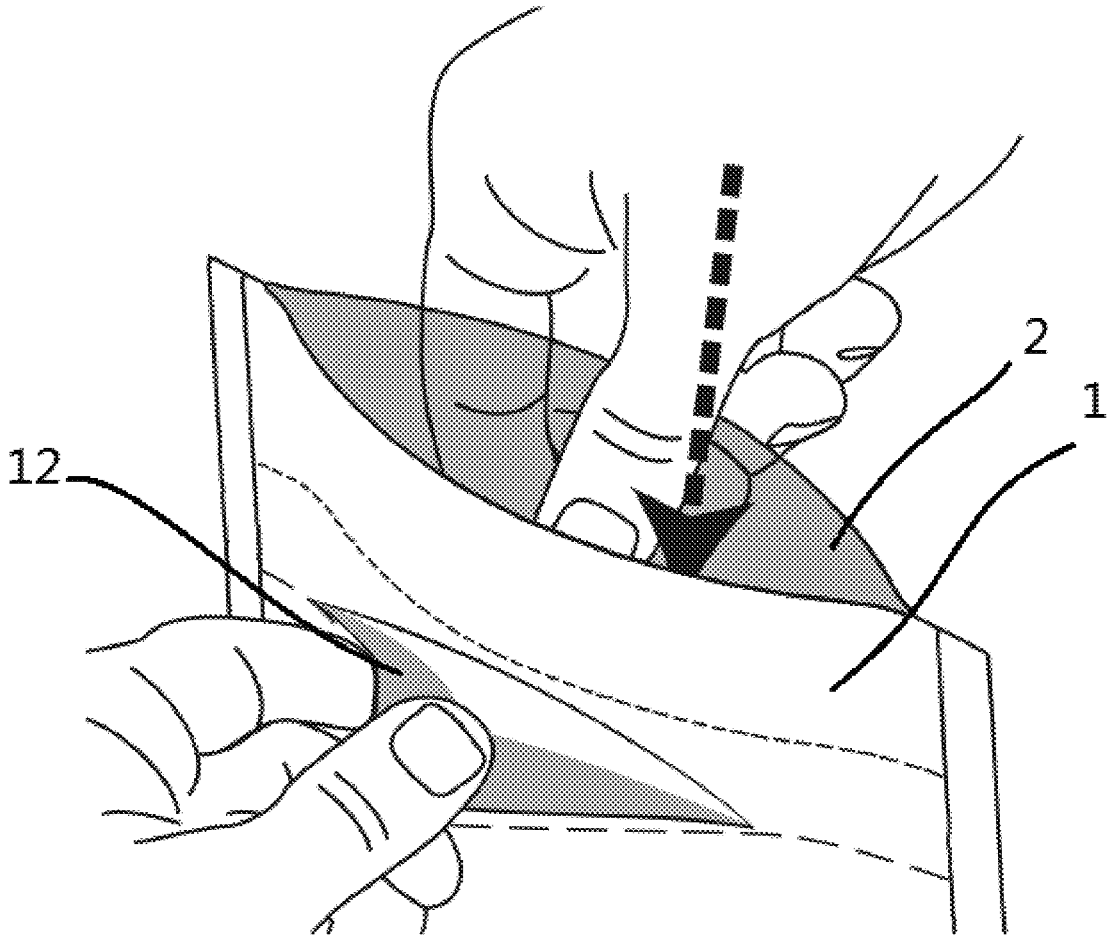
FIG. 5 is a working principle diagram of opening a child resistant zipper bag of the present invention.
Figure 6:
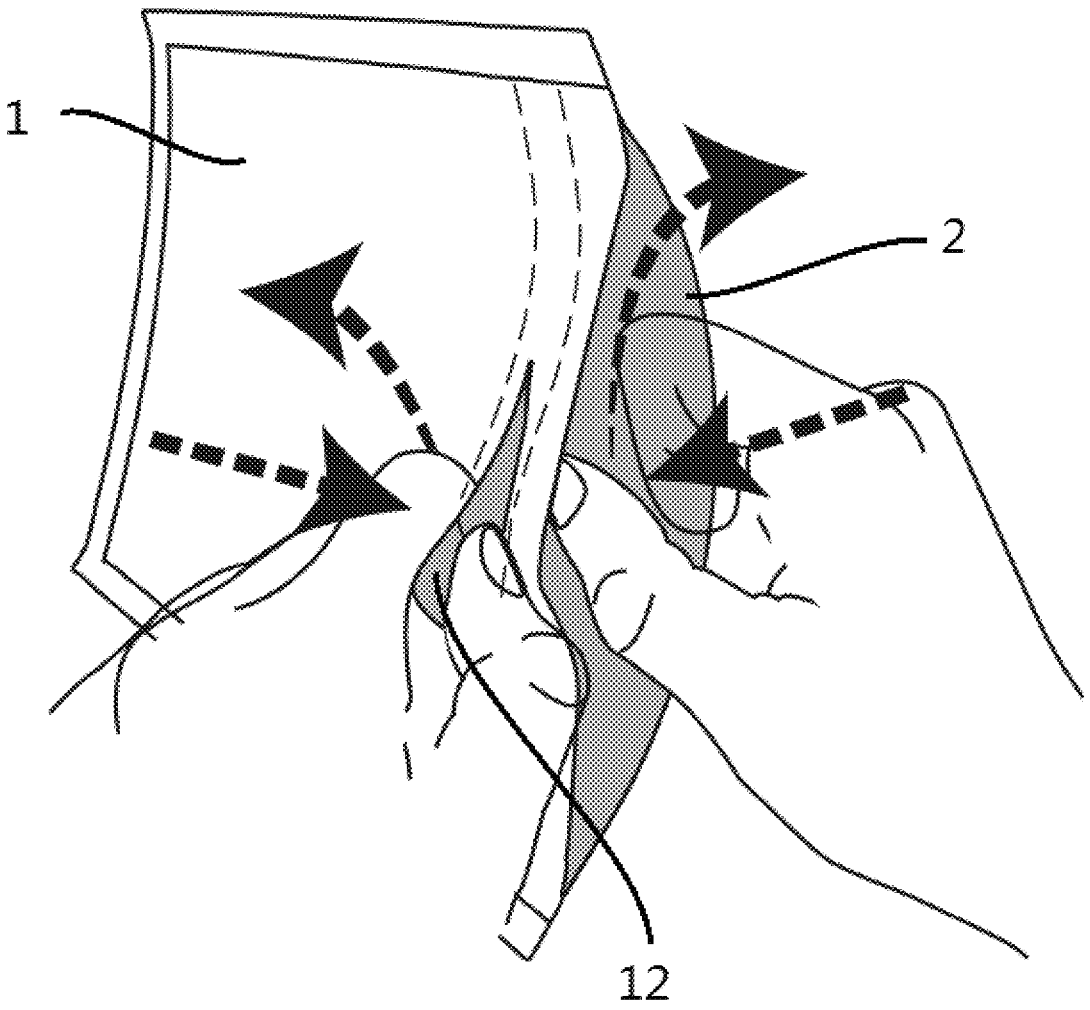
FIG. 6 is another working principle diagram of opening a child resistant zipper bag of the present invention.
Figure 7:
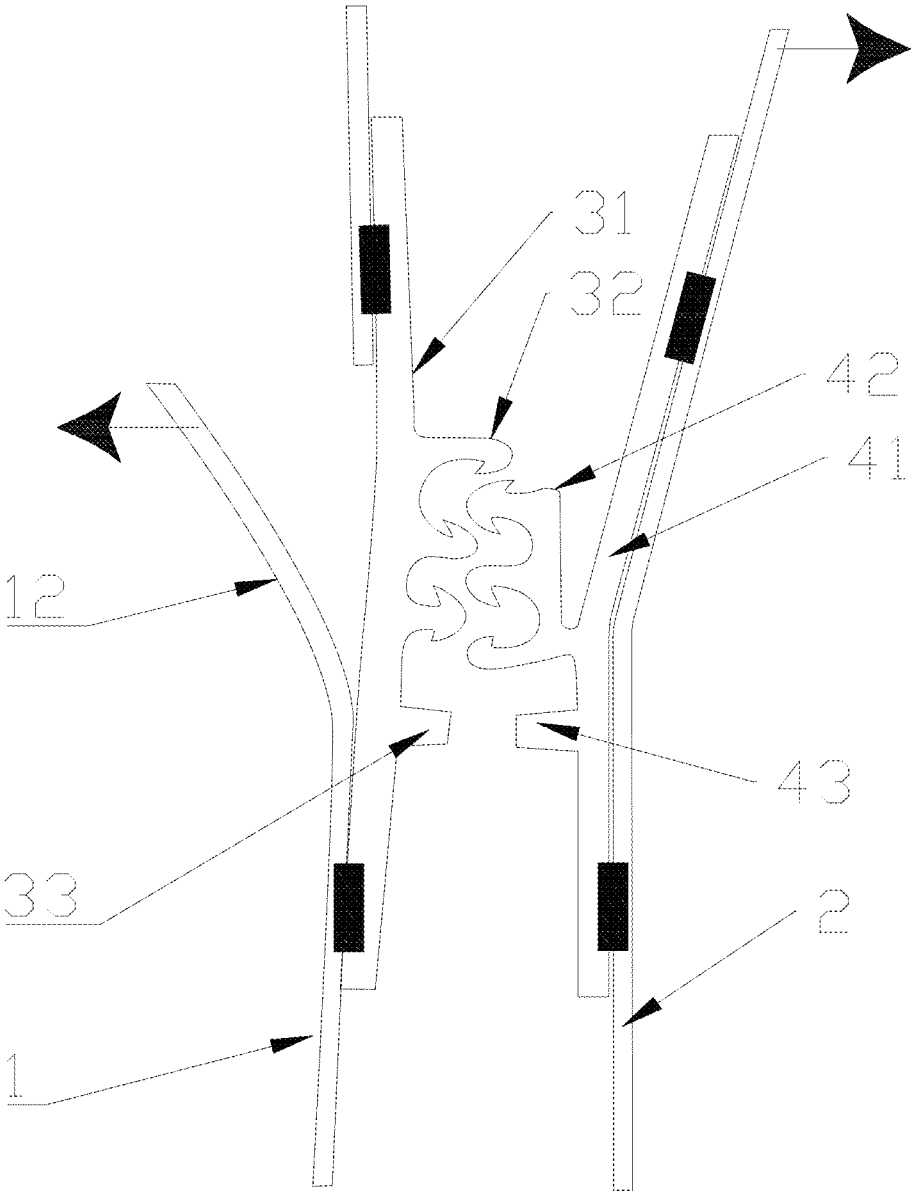
FIG. 7 is a side sectional view of a child resistant zipper bag when a user pulls a bag body in a special way.

As shown in FIGS. 5-7, when the user forcibly pulls the auxiliary open flap 12 and the upper end of the rear sheet 2 to both sides respectively, the pulling force on one side is acted on the joint between the zipper female rail 42 and the female-end fixing strip 41, and the pulling force on the other side is acted on the lower end of the zipper male rail 32, so that the zipper female rail 42 and the zipper male rail 32 may be separated, thereby opening the bag body. The zipper of the child resistant zipper bag is designed with a special structure and is only opened in a special way, so that children can be effectively prevented from opening the bag casually. The child resistant zipper bag is especially suitable for packaging articles that may be harmful to children, thereby playing a role of protecting children, and has high security and good practicability.

Figure 8:
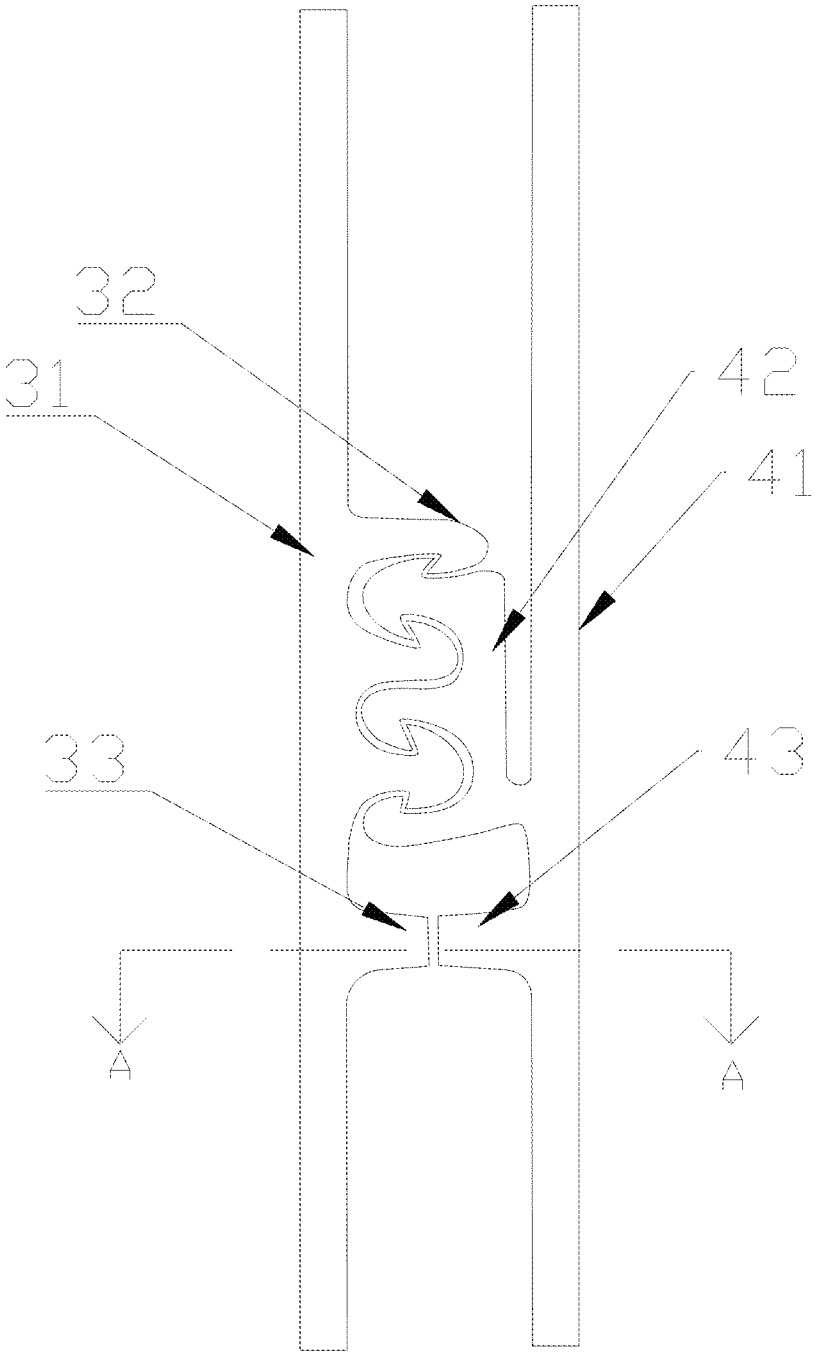
FIG. 8 is a structural schematic diagram after a zipper female rail and a zipper male rail are engaged.
Figure 9:
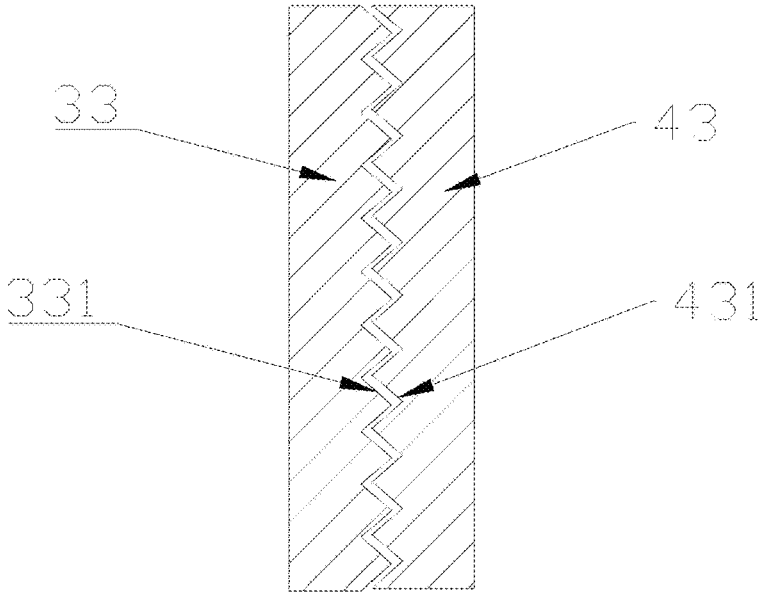
FIG. 9 is a sectional view of FIG. 8 taken along section line A-A.
Figure 10:
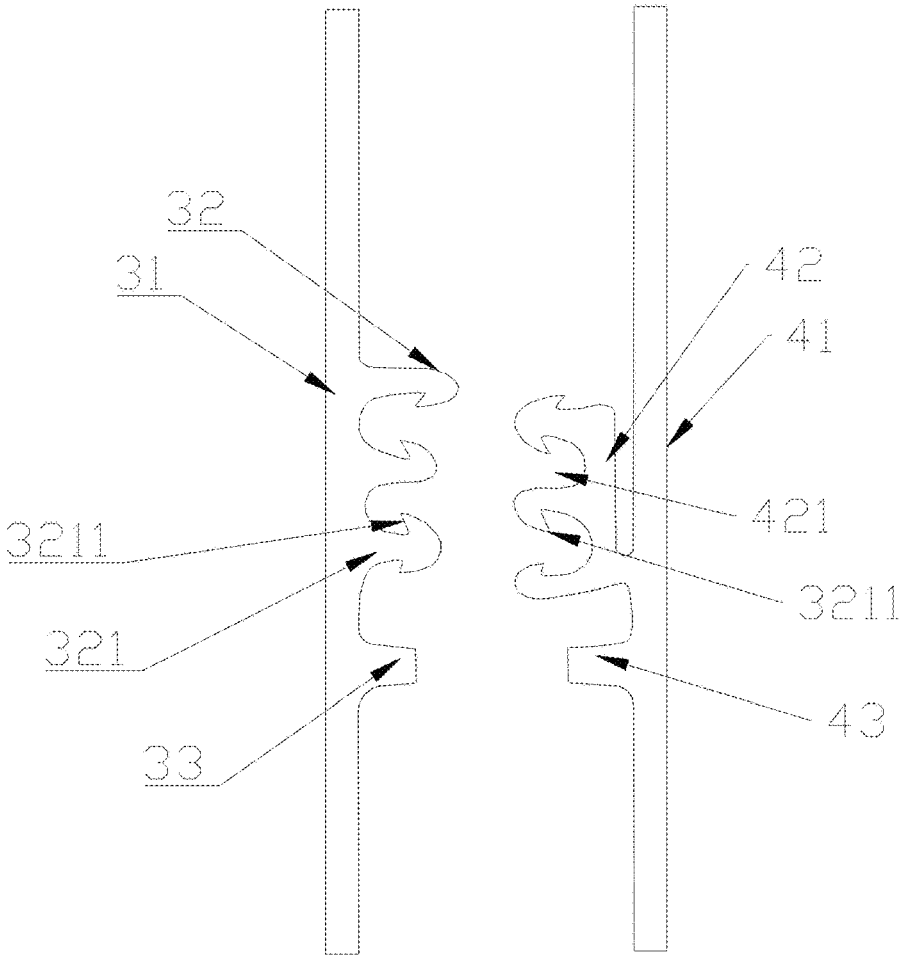
FIG. 10 is a structural schematic diagram after a zipper female rail and a zipper male rail are separated.

As shown in FIGS. 8-9, the first connection bar 33 is assembled with the second connection bar 43 through second meshing teeth 431 being meshed by first meshing teeth 331 while the zipper female rail 42 and the zipper male rail 32 are engaged. Therefore, the movement between the first zipper belt and the second zipper belt is limited, and the opening of the bag body due to sliding between the first zipper belt and the second zipper belt is avoided.

As shown in FIGS. 1-10, further, both the zipper male rail 32 and the first connection bar 33 are unitarily molded on the inner side surface of the male-end fixing strip 31. Further, both the zipper female rail 42 and the second connection bar 43 are unitarily molded on the inner side surface of the female-end fixing strip 41. In this specific embodiment, both the zipper male rail 32 and the first connection bar 33 are unitarily molded on the inner side surface of the male-end fixing strip 31, and both the zipper female rail 42 and the second connection bar 43 are unitarily molded on the inner side surface of the female-end fixing strip 41. Therefore, in the production process, there is no need to additionally produce a zipper male rail 32, a first connection bar 33, a zipper female rail 42, and a second connection bar 43, and there is also no need to additionally assemble the zipper male rail 32 and the first connection bar 33 on the male-end fixing strip 31 and assemble the zipper female rail 42 and the second connection bar 43 on the female-end fixing strip 41, reducing the assembling difficulty and improving the production efficiency.

As shown in FIGS. 1-10, further, the zipper female rail 42 and the zipper male rail 32 are arranged in parallel and in alignment with each other. The parallel arrangement between the zipper female rail 42 and the zipper male rail 32 can ensure that the zipper female rail and the zipper male rail are tightly engaged with each other, ensuring a good sealing effect of the bag.

Further, the first connection bar 33 and the second connection bar 43 are arranged in parallel and in alignment with each other. The parallel arrangement between the first connection bar 33 and the second connection bar 43 can ensure that the first connection bar and the second connection bar are tightly meshed with each other, therefore, the movement between the first zipper belt and the second zipper belt can be limited, and the opening of the bag body caused by sliding between the first zipper belt and the second zipper belt can be avoided, ensuring a sealing effect of the bag.

Further, the auxiliary flap slot 11 is of a circular arc structure. In this specific embodiment, if the auxiliary flap slot 11 is of a circular arc structure, accordingly the resulting auxiliary open flap 12 is of a fan-shaped structure which is convenient for a user to hold and exert force.

Further, the zipper male rail 32 consists of a plurality of strip-shaped protrusions 321, the zipper female rail 42 consists of a plurality of strip-shaped grooves 421, barbs 3211 are provided at the top ends of the strip-shaped protrusions 321 and the strip-shaped grooves 421, and the strip-shaped protrusions 321 are embedded into the strip-shaped grooves 421.

Further, the side surface of the auxiliary open flap 12 is provided with a prompting sign 121. The prompting mark may facilitate the user to find the stress-point for opening the bag.

The working principle of opening the child resistant zipper bag is described in detail as follows:

As shown in FIGS. 5-6, it is assumed that the user holds the auxiliary open flap 12 by his/her left hand and holds the upper end of the rear sheet 2 by his/her right hand, and pulls the auxiliary open flap 12 and the upper end of the rear sheet 2 to both sides respectively;

as shown in FIG. 7, because the left hand acts on the auxiliary open flap 12, the stress-point of the front sheet 1 is located at the joint between the lower end of the male-end fixing strip 31 and the front sheet 1; meanwhile, because the right hand acts on the upper end of the rear sheet 2, the stress-point of the rear sheet 2 is located at the joint between the zipper female rail 42 and the female-end fixing strip 41, because the left hand does not act on the upper end of the front sheet 1 instead, accordingly the free end of the zipper female rail 42 is not biased toward the male-end fixing strip 31 instead, moreover, because the stress-point of the front sheet 1 is located at the lower end of the zipper male rail 32, the plurality of strip-shaped protrusions 321 on the zipper male rail 32 are made to move in the direction away from the strip-shaped grooves 421, the plurality of strip-shaped protrusions 321 are sequentially separated from the strip-shaped grooves 421 from bottom to top, and the first zipper belt is divorced from the second zipper belt.

The above embodiments are provided to illustrate the preferred embodiments of the present invention but are not intended to limit the scope of the present invention. Without departing from the design spirit of the present invention, those of ordinary skill in the art make various modifications and improvements to the technical solution of the present invention, all of which shall fall within the protection scope defined in the claims of the present invention.

What is claimed is:

1. A child resistant zipper bag, comprising a zipper and a bag body, wherein the zipper is mounted in the bag body; the bag body comprises a front sheet and a rear sheet, the front sheet and the rear sheet realizing opening or closing through the zipper, and characterized in that: the zipper comprises a first zipper belt and a second zipper belt, the first zipper belt comprises a male-end fixing strip, wherein the inner side surface of the male-end fixing strip is provided with a first connection bar extending in the length direction of the male-end fixing strip and a zipper male rail extending in the length direction of the male-end fixing strip, and the surface of the first connection bar is provided with continuous first meshing teeth; the second zipper belt comprises a female-end fixing strip, wherein the inner side surface of the female-end fixing strip is provided with a second connection bar extending in the length direction of the female-end fixing strip and a zipper female rail extending in the length direction of the female-end fixing strip, and the surface of the second connection bar is provided with continuous second meshing teeth; the zipper male rail is assembled with the zipper female rail, and the first connection bar is assembled with the second connection bar through the first meshing teeth being engaged with second meshing teeth; the upper end and the lower end of the male-end fixing strip are respectively heat-sealed and fitted to the inner side surface of the front sheet, and the upper end and the lower end of the female-end fixing strip are respectively heat-sealed and fitted to the inner side surface of the rear sheet; neither the part between the upper end of the male-end fixing strip and the lower end of the male-end fixing strip nor the zipper male rail is heat-sealed and fitted to the front sheet, forming a non-heat-sealed fitting region; an auxiliary flap slot is delimited on the outer side surface of the front sheet corresponding to the non-heat-sealed fitting region, and an auxiliary open flap is formed, the auxiliary open flap being outward turned around the joint between the lower end of the male-end fixing strip and the front sheet.

2. The child resistant zipper bag according to claim 1, characterized in that both the zipper male rail and the first connection bar are unitarily molded on the inner side surface of the male-end fixing strip.

3. The child resistant zipper bag according to claim 1, characterized in that both the zipper female rail and the second connection bar are unitarily molded on the inner side surface of the female-end fixing strip.

4. The child resistant zipper bag according to claim 1, characterized in that the zipper female rail and the zipper male rail are arranged in parallel and in alignment with each other.

5. The child resistant zipper bag according to claim 1, characterized in that the first connection bar and the second connection bar are arranged in parallel and in alignment with each other.

6. The child resistant zipper bag according to claim 1, characterized in that the auxiliary flap slot is of a circular arc structure.

7. The child resistant zipper bag according to claim 1, characterized in that the zipper male rail consists of a plurality of strip-shaped protrusions, the zipper female rail consists of a plurality of strip-shaped grooves, barbs are provided at the top ends of the strip-shaped protrusions and the strip-shaped grooves, and the strip-shaped protrusions are embedded into the strip-shaped grooves.

8. The child resistant zipper bag according to claim 1, characterized in that the side surface of the auxiliary open flap is provided with a prompting sign.

* * * * *